United States Patent [19]

Williams

[11] 3,981,300

[45] Sept. 21, 1976

[54] OXYGEN SUPPLY SYSTEMS FOR AIRCRAFT

[76] Inventor: Irving Williams, 4 Harav Uziel St., Tel Aviv, Israel

[22] Filed: Jan. 22, 1975

[21] Appl. No.: 543,072

[52] U.S. Cl. ..... 128/142 R; 222/6; 222/55; 222/56; 222/76; 128/204

[51] Int. Cl.[2] ..... A62B 7/08

[58] Field of Search ..... 222/6, 3, 52, 56, 55, 222/76, 6.55–6.56; 137/114; 128/203, 191 R, 142, 142 R, 204; 244/118 P

[56] References Cited

UNITED STATES PATENTS

| | | | |
|---|---|---|---|
| 1,285,497 | 11/1918 | Wallace et al. | 222/6 X |
| 2,931,355 | 4/1960 | Miller et al. | 128/203 X |
| 3,016,061 | 1/1962 | Maddock | 128/203 X |
| 3,536,070 | 10/1970 | Bovard | 128/203 X |
| 3,615,250 | 10/1971 | Vernon | 222/3 X |
| 3,726,649 | 4/1973 | Pelham | 222/3 X |
| 3,733,008 | 5/1973 | Churchill et al. | 222/6 |

*Primary Examiner*—Robert B. Reeves
*Assistant Examiner*—Charles A. Marmor
*Attorney, Agent, or Firm*—Benjamin J. Barish

[57] ABSTRACT

A system for supplying oxygen to an aircraft cabin, comprises a plurality of chemical oxygen generators each including an ignitor for igniting same; a sequencer energizing the igniters in sequence; a plurality of oxygen masks within the aircraft cabin; an oxygen distribution system distributing the oxygen from the chemical generators to the masks; and a pressure sensor sensing the pressure in a predetermined part of the distribution system and controlling the sequencer to energize the igniter of the next chemical generator in sequence whenever the pressure in that part of the distribution system drops below a predetermined minimum.

5 Claims, 2 Drawing Figures

OXYGEN SUPPLY SYSTEMS FOR AIRCRAFT

BACKGROUND OF THE INVENTION

The present invention relates to oxygen supply systems for aircraft. The systems of the present invention may be embodied both as original equipment for new aircraft, and as conversion equipment for converting existing aircraft.

Aircraft operating above certain altitudes require an oxygen supply system for both the passengers and the crew. The oxygen supply system for the passengers is an emergency system, to supply oxygen in the event of a decompression in the airplane cabin while the aircraft is above 14,000 ft. The system for the crew supplies oxygen on a demand basis, continuously or intermittently at the rate required.

Most or all of the oxygen supply systems used in presently operational aircraft are supplied by high pressure oxygen tanks, which have a number of dis-advantages: First, such systems are hazardous, involving both a pneumatic hazard because of the high pressure gas (usually about 1800 p.s.i), and also a fire hazard particularly when refilling the oxygen cylinders; most operators go to great expense to minimize these hazards by employing specially trained personnel and specially designed maintenance, ground-servicing and oxygenrecharging equipment. Further, high pressure oxygen cylinders have some leakage; accordingly, this may require frequent refilling of the cylinders, maintaining large inventories of cylinders for replenishment, relocating the cylinders to different line stations, and periodically testing the cylinders, all of which involve added costs and possibly even departure delays.

Some military aircraft use liquid oxygen sources, but these also involve similar drawbacks.

SUMMARY OF THE INVENTION

An object of the present invention is to provide a system for supplying oxygen to an aircraft cabin, comprising; a plurality of chemical oxygen generators each including an igniter for igniting same; a sequencer energizing the igniters in sequence; a plurality of oxygen masks within the aircraft cabin; an oxygen distribution system distributing the oxygen from the chemical generators to the masks; and a pressure sensor sensing the pressure in a predetermined part of the distribution system and controlling the sequencer to energize the igniter of the next chemical generator in sequence in response to the pressure in said part of the distribution system. The distribution system includes a common chamber, a conduit from each chemical generator to the common chamber, and a conduit from each oxygen mask to the common chamber.

Chemical oxygen generators are known and have already been used, for example in submarines. The generators are heremetically sealed in light-weight metal containers and include igniters, usually percussion-cap type. When ignited, the generator releases oxygen at a predetermined rate according to the specific design of the generator used, leaving a residue which resembles a solid ash. Once the generator is ignited it releases the oxygen at the predetermined rate until it is completely consumed.

A number of advantages are provided by the use of chemical oxygen generators in the aircraft oxygen supply systems of the present invention: First, there is the safety advantage in that the pneumatic and fire hazards are substantially reduced or eliminated. There is also the logistics advantage, in that generators are available having a 10 year shelf life with very stable storage, and therefore the need to maintain a large inventory of cylinders or to recharge or transport them, would be substantially reduced or eliminated. Such a system is very reliable since it experiences no leakage and has a very long shelf life. Further, such a system would not require specially trained servicing personnel or special servicing equipment, and therefore the aircraft turnaround time could probably be reduced. In addition, the oxygen system could be serviced in a simple manner and only when used, and therefore would not cause departure delays. Further, since all the generators and all the oxygen masks are connected to a common source, namely, the common tank of the distribution system, there is little danger of any mask being deprived of oxygen should any one generator malfunction or become exhausted.

The present invention may be embodied in emergency supply systems for supplying oxygen to the passengers on an emergency basis, or in a demand system for supplying oxygen on a continuous or intemittent basis to the crew. Example of both such systems are described herein.

In the emergency supply system, e.g. for supplying oxygen to the passengers, the oxygen distribution system includes a distribution manifold, the pressure of which is sensed by the pressure sensor. In this case, the pressure sensor controls the sequencer in response to the ratio of the pressure in the distribution manifold to the pressure in the aircraft cabin. For example, if decompression should occur at relatively low altitudes, the chemical generators would be ignited sequentially to maintain a relatively low minimum manifold pressure, (e.g. about 1.2 psi at 14,500 ft.); but if a decompression should occur at a much higher altitude, the chemical generators would be sequentially ignited to maintain a much higher minimum manifold pressure (e.g., about 50 psi, at 40,000 ft.).

In the demand oxygen supply system, e.g., for supplying oxygen to the aircraft crew, the oxygen distribution system includes an oxygen reservoir tank fed by the chemical oxygen generators. The pressure of the reservoir tank is sensed by the pressure sensor to sequentially control the ignition of the chemical oxygen generators. In the system described, the oxygen reservoir tank is under pressure, preferably about 550 psi, and feeds the oxygen to the crew stations through a pressure reducer.

Further features and advantages of the invention will be apparent from the description below:

BRIEF DESCRIPTION OF THE DRAWINGS

The invention is herein described, somewhat diagramatically and by way of example only, with reference to the accompanying drawings, wherein.

DESCRIPTION OF THE PREFERRED EMBODIMENTS

Figure 1:
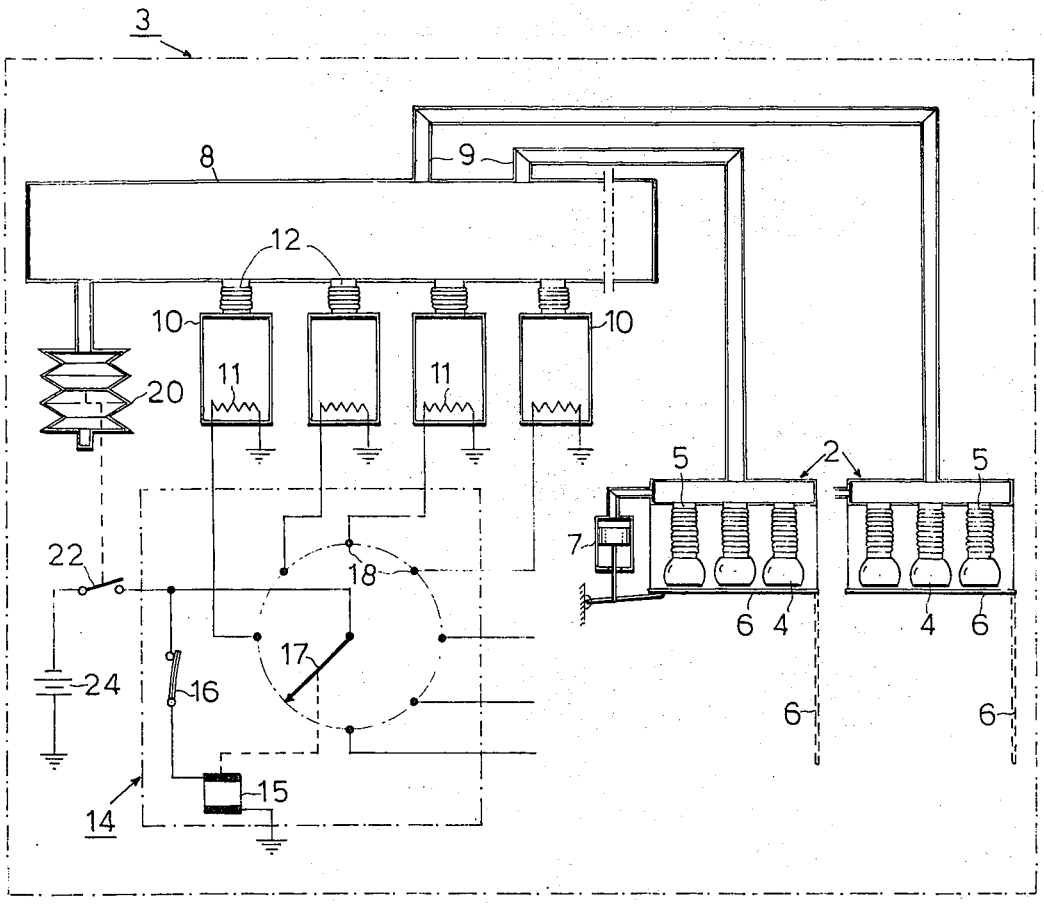
FIG. 1 schematically illustrates an aircraft emergency oxygen supply system constructed in accordance with the invention, for example for supplying oxygen to the passengers of a commercial aircraft.

The FIG. 1 Embodiment

The oxygen supply system illustrated in FIG. 1 supplies oxygen on an emergency basis, for example to the passenger compartment of a commercial aircraft. This system comprises a plurality of passenger service units 2 disposed in the aircraft cabin 3 usually above the passenger seats. Thus, there may be one passenger service unit 2 for every group (e.g., of three) passenger seats. Each service unit 2 includes an oxygen mask 4 for each passenger in that group, each mask being connected by a conduit or hose 5. The arrangement is such that in the event of a sudden decompression in the passenger cabin such that the pressure corresponds to an altitude of more than about 14,000 ft., the passenger service units 2 are automatically actuated to drop their respective oxygen masks 4 into a position easily accessible to the passengers. This is schematically shown by panels 6 supporting the oxygen masks which panels are actuatable to their open positions (shown in broken lines) by an actuator (shown as pneumatic piston 7, known per se) to drop the masks. The passenger service units 2 and their respective oxygen masks 4 are supplied by oxygen through the conduit 9 connected to the distribution manifold 8.

The system insofar as described is conventional in existing aircraft, and therefore further details of construction are not deemed necessary. In the conventional system, however, distribution manifold 8 is supplied from high-pressure (e.g., 1,800 psi) oxygen cylinders, and therefore such systems suffer from the disadvantages discussed earlier.

In the present invention, distribution manifold 8 is supplied from a plurality of chemical oxygen generators 10 of the known type briefly described above. Each generator includes an igniter 11, preferably electrical, which, when energized, ignites the generator to cause it to release its oxygen at a predetermined rate until exhausted. The released oxygen is fed to distribution manifold 8 via a conduit or hose 12 from each generator, the distribution manifold serving as a common chamber for all the generators and all the oxygen masks.

The ignition of the chemical generator is controlled by a sequencer, generally designated 14. The sequencer is schematically illustrated as coil 15 energized through a time-delay bimetallic switch 16 to cause a movable contact 17 to sequentially engage a plurality of fixed contacts 18, each of the latter contacts being connected to the electrical igniter 11 of one of the chemical generators 10. Sequencer 14 is controlled by a pressure sensor 20 having an electrical switch 22 which, when closed, actuates sequencer 14 to cause its movable contact 17 to sequentially ignite the chemical generators 10.

Pressure sensor 20 is of a known type which senses the ratio of the pressure within distribution manifold 8 to the pressure in the passenger compartment 3, and if this ratio is below predetermined limit, the sensor closes switch 22. Such pressure sensors are known in existing oxygen supply systems wherein the sensor controls a valve from the high-pressure oxygen supply tanks. In the present case, however, the pressure sensor controls an electrical switch (22) instead of a valve, which switch in turn controls the sequencer 14. The arrangement is such that pressure sensor switch 22 will be closed whenever, and so long as, the pressure within the distribution manifold 8 is below the predetermined limit for the particular altitude of the passenger cabin, whereupon sequencer 14 will be energized to sequentially ignite the chemical generators 10.

That is to say, and as well known in sequencers of this type, whenever pressure-sensor switch 22 is closed, coil 15 is energized from battery 24 via the circuit including switch 22 and the normally-closed bimetallic switch 16 to advance movable contact 17 one position to the next fixed contact 18 (the mechanical connection between the armature of coil 15 and contact 17 being schematically shown by the broken lines in FIG. 1) at which time bimetallic switch 16, being heated by the current flowing through it, opens the circuit; and after a time delay (when the bimetallic switch has cooled), the bimetallic switch again closes so that if pressure sensor switch 22 is still closed, coil 15 is again energized to advance movable contact 17 another position to engage the next fixed contact 18.

As soon as the predetermined pressure-ratio has been attained, and so long as it is maintained, sensor switch 22 will be open and the sequencer 14 will be deenergized, whereby no further generators will be ignited.

For purposes of example, the minimum manifold pressures for closing sensor switch 22 and thereby effecting the ignition of the next generator in the sequence, are: 1.2 psi for 14,500 ft. cabin pressure altitude; 14.9 psi for 20,000 ft. cabin pressure altitude; 36.1 psi for 30,000 ft. cabin pressure altitude; and 50.6 psi for 40,000 ft. cabin pressure altitude. All pressures herein are gauge pressures.

The system for igniting the chemical generators is shown schematically by the electrical circuit including battery 24 connected to the igniters 11 of the generators through pressure-sensor switch 22 and sequencer 14. The sequencer 14 is shown schematically as including coil 15, bimetallic switch 16, movable contact 17, and fixed contacts 18.

The operation of the system of FIG. 1 will be apparent from the above description. So long as the pressure within the aircraft cabin is below that of 14,000 ft. altitude, pressure-sensor switch 22 is open, no generators 10 are ignited, and no oxygen is supplied to the distribution manifold 8. In case of a decompression such that the cabin pressure falls so as to correspond to an altitude greater than 14,000 ft., as sensed by pressure sensor 20, the latter closes switch 22. This energizes coil 15 of sequencer 14, stepping its movable contact 17 to engage its first fixed contact 18. This ignites the first chemical generator 10 to supply oxygen to the passenger service units 2, thereby actuating their pneumatic pistons 7 to unlatch their respective panels 6 to drop the masks 4, and to supply oxygen to the masks through the distribution manifold 8. Coil 15 is then deenergized by the opening of bimetallic switch 16. However, pressure sensor 20 continuously senses the ratio of the pressure in distribution manifold 8 to the pressure within the cabins, and if this ratio is below the predetermined limit, switch 22 will remain closed. After a short time delay, bimetallic switch 16 recloses, reenergizing coil 15 which steps its contact 17 to engage the next fixed contact 18 to ignite the next generator 10.

Thus, whenever and so long as pressure-sensor switch 22 is closed, sequencer 14 will be actuated to ignite the generators 10 in sequence until the pressure ratio is equal to or higher than that required for the cabin pressure. As each generator is ignited, it supplies oxygen to the distribution manifold 8, according to a predetermined rate until it is completely exhausted.

Preferably, the first generators 10 to be ignited are of larger capacity than the later ones, so that the first ones quickly supply a large quantity of oxygen to the distribution manifold, whereas the later ones supply a sustaining quantity of oxygen. As one example, the system could include 10 generators, each supplying 210 liters/minute for a total quantity of 630 liters each, and 6 generators each supplying 25.5 liters/minute also for a total quantity of 825 liters each.

Figure 2:
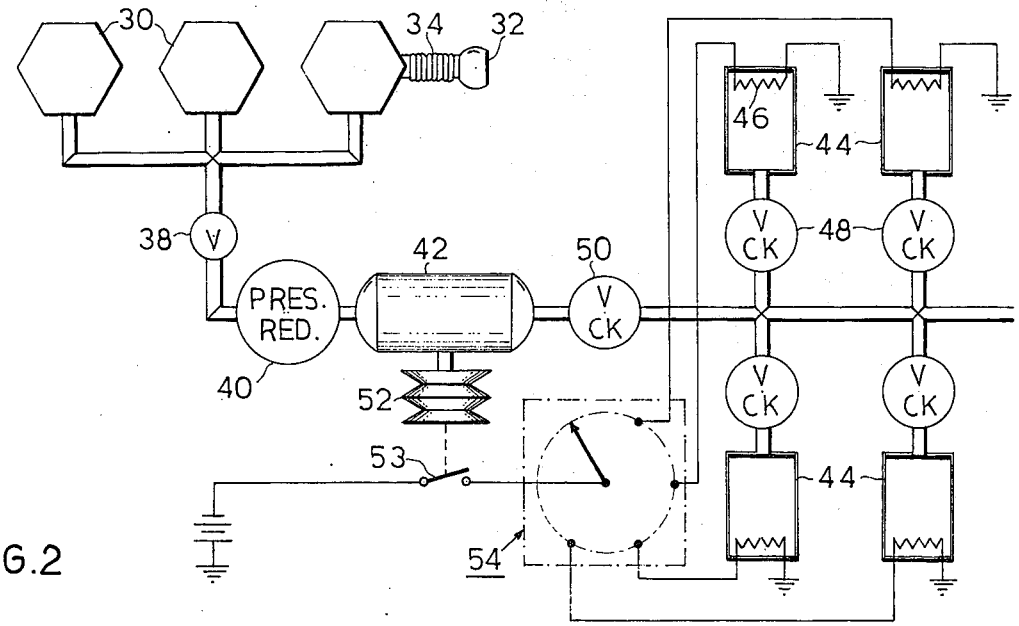
FIG. 2 illustrates a demand oxygen supply system constructed in accordance with the invention, for example for supplying oxygen to the crew of a civilian aircraft, or to the pilot or crew of a military aircraft, on demand.

The FIG. 2 Embodiment

The system illustrated in FIG. 2 is for purposes of providing a supply of oxygen on a demand basis such as for the crew of a commercial or military aircraft.

The system of FIG. 2 includes a plurality of crew stations 30 each having an oxygen mask 32 connected by a hose 34, regulated by a regulator (not shown). All the crew stations 30 are supplied through an oxygen distribution system which includes a shut-off valve 38 and a pressure reducer 40. The system, insofar as described, is conventional in existing aircraft and therefore it is not deemed necessary to provide further particulars. In the conventional systems, pressure reducer 40 is connected to high-pressure oxygen tanks.

According to the present invention, the inlet to pressure-reducer 40 is connected to an oxygen tank reservoir 42 which is fed by a plurality of chemical oxygen generators 44 each having an electrical igniter 46. A check valve 48 is included in the hose or conduit connected to the outlet end of each generator 44, and an additional check valve 50 is interposed in the line between the generators and reservoir tanks 42.

A pressure sensor 52 is provided to sense the pressure within the reservoir tank 42. The pressure sensor includes an electrical switch 53 which actuates sequencer 54 to energize the igniters of the chemical oxygen generators in sequence so long as the pressure within the reservoir tank 42 is below a predetermined minimum.

As one example, each generator 44, when ignited, would supply sufficient oxygen to reservoir 42 to raise the pressure within the reservoir to 550 psi. This pressure is reduced by pressure-reducer 40 to 75 psi and is continuously supplied to the crew stations 30, but may be shut off by valve 38. If pressure sensor 52 senses a pressure within reservoir 42 below 150 psi, it will close switch 53 to actuate sequencer 54 to cause the latter to ignite the next generator 44 in the sequence, in the manner described with respect to the system of FIG. 1, whereupon that generator will replenish the oxygen within rerservoir 42.

The sizes of the reservoir 42 and of the chemical generators 44 are selected so that the maximum pressure that can be attained in reservoir 42 is preferably about 550 psi, i.e., below 600 psi which is considered by some to be the threshold of auto-ignition. Lower pressures could be used, but the size of the reservoir would then have to be increased.

The generators 44 would preferably be in the form of expendable cores quickly insertable in and removable from quick-sealing pressure casings permanently installed in the aircraft. The electrical connections would be made through a plug and socket when the expendable core is inserted into the pressure casing and the pressure casing is closed. The check valve 48 at each generator permits the generator to be recharged without losing the reservoir pressure. For purposes of example, each aircraft could include four generators, only one of which would normally be used for a normal flight consuming 600 liters of oxygen.

The sequencer 54, as well as 14 in FIG, 1, may be an electrically-actuated stepping switch of any known design which, when energized by the pressure-sensor switch (52 or 22), moves its contactor to its first position thereby igniting the generator of that position, and if after a predetermined time interval the pressure-sensor switch remains closed, moves its contactor to the next position to ignite the enext generator, and so on through the sequence. The illustrations of such a sequencer in FIGS. 1 and 2 are merely schematical.

An additional advantage is that the pressure sensor, in the system of the present invention, effects the closing or opening of an electrical switch to control the supply of the oxygen from the oxygen source. This "on-off" control is more reliable and less likely to malfunction than the continuous-regulation control of the pressure sensors in existing systems which pressure sensors control a valve from the high-pressure oxygen tanks.

For further safety, the aircraft may include a duplicate or redundant oxygen supply system, including a seperate bank of oxygen generators, igniters, sequencer, and/or pressure sensor.

Further variations, modifications and applications of the illustrated embodiments will be apparent.

What is claimed is:

1. A system for supplying oxygen to oxygen masks in an aircraft cabin, comprising: a plurality of chemical oxygen generators each of the type actuated by an igniter and each including igniter means which, when energized, causes its chemical oxygen generator to generate oxygen; sequencer means connected to said igniter means for energizing same in sequence; a plurality of oxygen masks within said aircraft cabin; an oxygen distribution system distributing the oxygen from said chemical oxygen generators to said oxygen masks in the aircraft cabin; said distribution system including a common chamber, a conduit from each of said chemical oxygen generators to said common chamber, and a conduit from each oxygen mask to said common chamber; and pressure sensing means disposed to sense the pressure in a predetermined part of said oxygen distribution system and controlling said sequencer means to energize said igniter means of said chemical oxygen generators in sequence in response to the pressure sensed in said part of the distribution system.

2. A system according to claim 1, wherein said common chamber of said oxygen distribution system is a distribution manifold fed by all said chemical oxygen generators, said pressure sensing means sensing the ratio of the pressure in said distribution manifold to the pressure in said aircraft cabin and controlling said sequencer means in response to said ratio of pressures to sequentially energize said igniter means of the chemical oxygen generators.

3. A system according to claim 1, wherein said common chamber of said oxygen distribution system is an oxygen reservoir tank fed by said chemical oxygen generators, said pressure sensing means sensing the pressure in said oxygen reservoir tank to sequentially energize said igniter means of the chemical oxygen generators whenever said pressure drops below a predetermined minimum.

4. A system according to claim 3, wherein said predetermined pressure in said oxygen reservoir tank is about 550 psi and said oxygen reservoir tank feeds the oxygen to the oxygen masks through a pressure reducer.

5. A system according to claim 1, wherein said igniter means of said chemical oxygen generators are electrically energized.

* * * * *